US005311236A

United States Patent [19]

Ueffinger et al.

[11] Patent Number: 5,311,236

[45] Date of Patent: May 10, 1994

[54] PROCESS AND DEVICE FOR THE FEEDING OF FLUID ADDITIVES, AND IN PARTICULAR THE FEEDING OF REPLENISHERS TO A PHOTOGRAPHIC PROCESSING FLUID

[75] Inventors: Gerhard Ueffinger, Weinstadt, Fed. Rep. of Germany; Andrew Green, Harrow, United Kingdom

[73] Assignee: Eastman Kodak Company, Rochester, N.Y.

[21] Appl. No.: 889,883

[22] Filed: May 29, 1992

[51] Int. Cl.[5] ..... G03D 3/02

[52] U.S. Cl. ..... 354/324

[58] Field of Search ..... 354/323, 324; 222/14; 235/214.25; 134/64 P, 64 R, 122 P, 122 R

[56] References Cited

U.S. PATENT DOCUMENTS

| | | | |
|---|---|---|---|
| 3,792,487 | 2/1974 | Peres | 354/324 |
| 4,415,011 | 11/1983 | Grant | 222/14 X |
| 4,888,607 | 12/1989 | Stutz et al. | 354/323 |
| 5,156,336 | 10/1992 | Hammond et al. | 239/214.25 |

FOREIGN PATENT DOCUMENTS

| | | | |
|---|---|---|---|
| 0216791 | 4/1987 | European Pat. Off. . | |
| 1497481 | 6/1969 | Fed. Rep. of Germany | 354/324 |
| 3310119 | 4/1990 | Fed. Rep. of Germany . | |
| 1465817 | 1/1966 | France | 354/324 |

*Primary Examiner*—D. Rutledge

*Attorney, Agent, or Firm*—Peter J. Bilinski

[57] ABSTRACT

Process and device for the feeding of fluid additives and, in particular, of replenishers to a photographic processing fluid. Fluid additives are supplied to the processing fluid contained in a photographic processing tank by a feeding duct. The feeding duct is filled with processing fluid before different fluid additives are introduced into the feeding duct. The volume of the fluid additive supplied is measured by a flow meter which is arranged in an area of the feeding duct which during the measuring operation carries only processing fluid and not the fluid additive being fed into the feeding duct.

16 Claims, 2 Drawing Sheets

31
23
29
51
37
41
49
26
27
12
45
47
F
P
11
6
7
5
9
3
1

14
A
31
23
29
51
37
41
49
26
27
12
45
47
F
P
11
6
7
5
9
3
1

13
W
23
29
25
51
37
33
49
41
26
27
12
45
47
F
P
11
6
7
5
9
3
1

PROCESS AND DEVICE FOR THE FEEDING OF FLUID ADDITIVES, AND IN PARTICULAR THE FEEDING OF REPLENISHERS TO A PHOTOGRAPHIC PROCESSING FLUID

BACKGROUND OF THE INVENTION

The invention relates to a process for the feeding of fluid additives to the fluid contained in a fluid system and, in particular, the feeding of replenishers to a photographic processing fluid contained in a photographic processing tank, wherein the fluid additive is entered at the first end of a feeding duct connected with the fluid system and discharged into the fluid system from a second end of said feeding duct.

Moreover, the invention relates to a device for feeding such a fluid additive. The device comprising a feeding duct whose first end is connected with the supply vessel for the fluid additive to be supplied and whose second end is connected with the fluid system to be supplied, further comprising at least one fluid feed pump and a valve arrangement which can be actuated by a control circuit and in which the feeding duct can be selectively cleared and blocked.

Feeding processes and devices of this type are known already. See, for example, EP 0 216 791 Bl. A preferred field of application of such processes and devices is the supply of a photographic processing fluid to photographic processing tanks. For this purpose a metered supply of fluid additives is provided such that the substances of the processing fluid consumed during operation are replenished in a suitable manner so that the processing fluid contained in the tank is regenerated, i.e., maintains or regains its functional properties. If the tank to be supplied is a developer tank it may be water, for example, and a number of concentrates each containing a component of the developer solution that have to be metered to the tank. If it is a fixing bath it is also water and at least one concentrate in the form of a concentrated fixing salt solution which are to be supplied for replenishment.

It is the object of the invention to provide a process which ensures a particularly reliable and economic supply of fluid additives to a system fluid and which is suitable in particular for the feeding of replenishers into photographic processing tanks.

In a process of the above type, this object is attained in accordance with the invention in that when different fluid additives are to be supplied, such fluids are successively fed into the feeding duct and in that prior to the feeding in of a fluid additive which differs from the fluid additive successively to be fed in, at least the area of the first end of the feeding duct is filled with system fluid.

Since the entrance area of the feeding duct is filled with system fluid before the fluid additive is fed, one single feeding duct can be used for all fluid additives, no matter what their chemical and physical properties are like. This was not possible so far because when certain concentrates are brought into direct contact or mixed, undesired chemical reactions occur which may lead, for example, to the formation of gases or the precipitation of substances. In the process according to the invention this danger is excluded because all additives are metered into the system fluid by which the feeding duct has previously been filled.

The invention not only offers an opportunity of using only one single feeding duct independently of the chemical nature of the fluid additives to be fed in, but also a further particularly advantageous opportunity of measuring the volume of the fluid additives supplied by means of a single flow meter which is arranged within the feeding duct.

If the fluid additives are also physically different a single flow meter may also be used subject to its arrangement in a location through which only system fluid flows during metering. In this manner a single flow meter exclusively calibrated for the system fluid can serve for determining the volume irrespectively of the fluid additive supplied. Owing to the great differences in the physical properties (viscosity and the like) of the various additives a flow meter specially calibrated for each of such fluid additives would otherwise be necessary.

In the case of a preferred embodiment, the feeding duct is filled with the system fluid using a fluid circulation system in which the system fluid is fed out of the fluid system by means of a feed pump and conveyed via a feedback duct to the first end of the feeding duct, such circulation being interrupted by the blocking of said feedback valve prior to the supply of another fluid additive into the feeding duct of the fluid circulation system and only cleared again when subsequent to such feeding, the feeding duct is once again to be filled with system fluid. In the case of such an embodiment the feeding duct can be constantly flushed with system fluid between successive supply operations so that it can be ensured that when another supply operation is initiated, the feeding duct is filled with fresh system fluid.

It is also an object of the invention to provide a device which is particularly suitable for the supplying of fluid additives to the system fluid :n a fluid system, and in particular of replenishers for a photographic processing fluid contained in a photographic processing tank.

SUMMARY OF THE INVENTION

According to the invention, a device for feeding a fluid additive is provided which comprises a feeding duct whose first end is connected with a supply vessel for the fluid to be supplied and whose second end is connected with the fluid system to be replenished, at least one feed pump for fluid as well as a valve arrangement which can be operated by a control circuit and by which the feeding duct can be selectively cleared and blocked, at least two supply vessels being provided for different fluid additives and the valve arrangement for each supply vessel having a feed valve, and a feedback duct connected in parallel with the feeding duct being provided through which system fluid can be withdrawn from the fluid system by means of the feed pump and returned to the first end of the feeding duct, and the valve arrangement comprising a controllable feedback valve which is arranged in the feedback duct and serves for selectively clearing and blocking the duct.

If such a device is used for replenishing the solution contained in photographic processing tanks, the control circuit actuating the valve arrangement can operate in the manner usual in photographic processing systems, namely on the basis of a control program which is designed such that the photographic processing fluid contained in the processing vessel or tank concerned is replenished in response to consumption. The consumption of the individual components of the system fluid, i.e., in this case the processing fluid, can be sensed or determined in that the surface of the photographic material processed in the tank is scanned. Suitable area scanners (film area scanners) are available in the field concerned. Instead of the replenishing of the fluid, the control program used may also allow a new formulation of the system fluid to be introduced, i.e., for example, a freshly formulated developer solution in a developer tank or a fixing bath in a fixing tank.

DESCRIPTION OF THE DRAWINGS

The invention be explained in detail with reference to an embodiment illustrated in the drawings wherein.

DETAILED DESCRIPTION OF THE INVENTION

Figure 1:
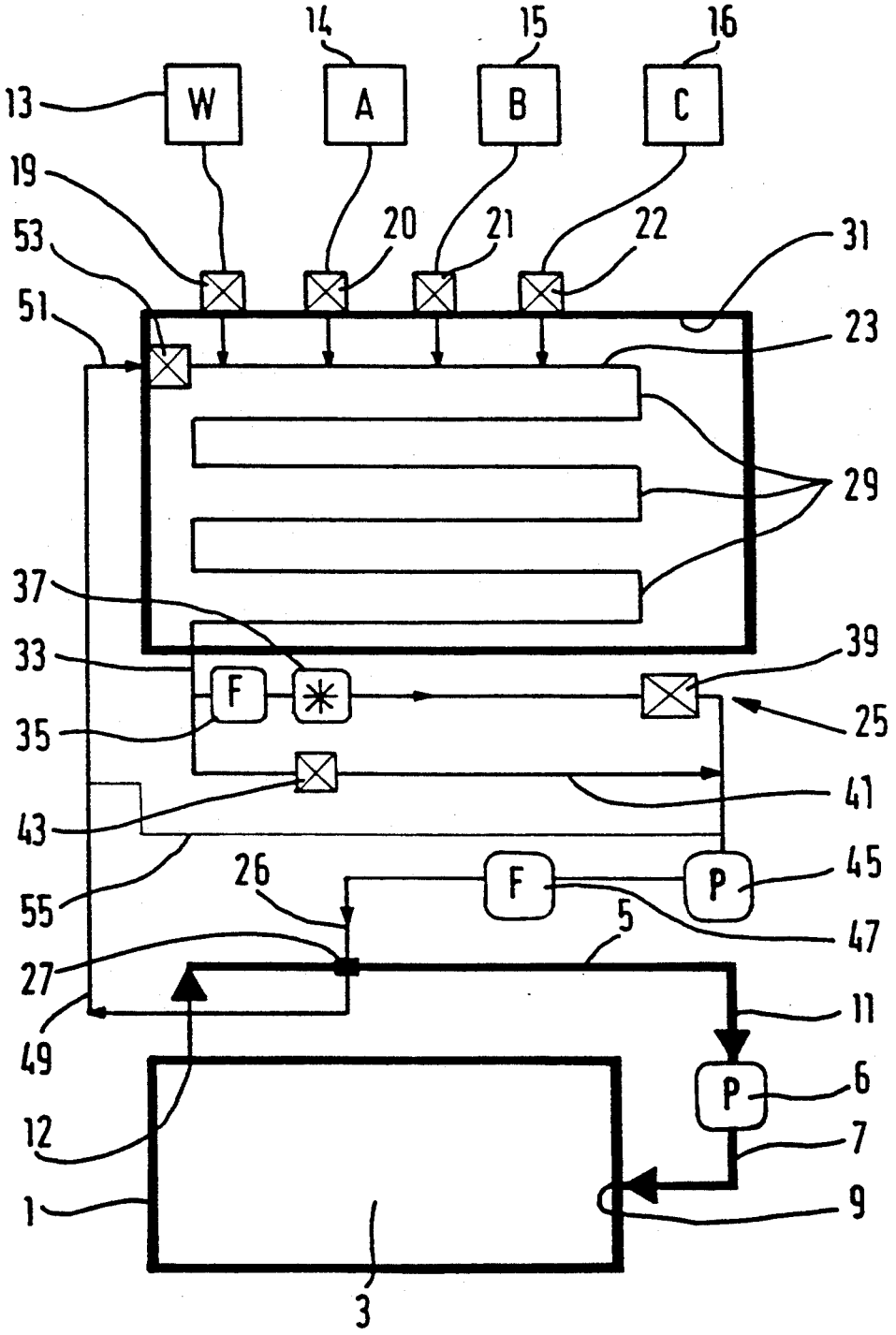
FIG. 1 shows a schematic view in the form of a block diagram of an embodiment of the feeding device.

The figures show an embodiment in which the feeding device cooperates with a fluid system in the form of a photographic development tank 1. In this case, the system fluid to be replenished with a fluid additive is a photographic developer solution 3 which is contained in tank 1 and serves for carrying out a photographic development process. Development tank 1 comprises a circulating duct 5 for circulating the bath, said duct including a circulating pump 6 and being connected to an inlet 9 of tank 1 with that end which is associated with the delivery side 7 of pump 6. The end of circulating duct 5 which is associated with the intake side 11 of pump 6 is connected with an outlet 12 of tank 1.

Fluid additives to be supplied to the developer solution 3 are contained in supply vessels 13, 14, 15 and 16 which are designed as air-tight shrink containers. Supply vessel 13, which is denoted W, contains water. The supply vessels 14, 15 and 16 contain concentrates A, B and C, respectively, which are components of the developer solution 3. Each supply vessel is connected by a separate feed valve 19, 20, 21 and 22, respectively, with a first upstream end 23 of a feeding duct generally denoted 25 whose other downstream end 26 terminates at a junction 27 in the circulating duct 5 of tank 1.

The supply valves 19 to 22 are part of a valve arrangement of the device which, as will be described below, includes further valves and which is controllable by means of a signal processing control circuit not illustrated in the drawing.

That part of feeding duct 25 which succeeds the first upstream end 23 forms a storage path 29 of a predetermined throughput or storage volume. The storage volume chosen will be discussed in more detail below in connection with the description of the functioning of the device. The storage path 29 consists of a meandrous groove which is cut into a storage plate 31 and is tightly closed at its open side by a cover plate (not illustrated in the drawing). At the downstream end of the storage path 29, feeding duct 25 exits from the storage plate 31 at an exit point 33.

That part of feeding duct 25 which extends downstream of the storage path 29 at exit point 33 is divided following said point into two branches. The first branch includes successively (relative to the flow direction) a filter 35, a flow meter 37 as well as a check valve 39. Like the other valves of the valve arrangement, the latter can be actuated by means of the control circuit. Flow meter 37 is a turbine flow meter which generates signal pulses corresponding o the indexing steps of its turbine wheel, which pulses are further processed in the control circuit.

The branch of feeding duct 25 which includes filter 35, flow meter 37 and check valve 39 is connected in parallel with a second branch which is a by-pass 41 including a second check valve 43 which is also part of the valve arrangement and can be actuated by the control circuit. Both the downstream end of bypass 41 and the branch of feeding duct 25 which contains the flow meter 37 are connected to the intake end of a feed pump 45. Another filter 47 is provided between the delivery side of feed pump 45 and the downstream end 26 of feeding duct 25 which terminates at junction 27 of the circulating duct 5.

At junction 27 where the end 26 of feeding duct 25 terminates in the circulating duct 5 at the intake side 11 of circulating pump, 6, another duct is connected, namely a feedback duct 49 whose end 51 which faces away from junction 27 is connected via a feedback valve 53 to the end 23 of feeding duct 25. The feedback valve 53 is part of the valve arrangement and can also be actuated by means of the control circuit, which will be explained in more detail further below.

The feedback duct 49 comprises between its two ends, i.e., between the connection at junction 27 and the end 51 connected to the feedback valve 53, a branch in the form of a connecting duct 55 which has a relatively small cross-section and whose end facing away from the feedback duct 49 terminates in feeding duct 25 at the intake side of feed pump 45.

The device functions as follows:

In the rest position, i.e., if no fluid additives have to be supplied from one of the supply vessels 13 to 16, a corresponding program of the control circuit causes the feeding valves 19 to 22 as well as the check valve on the branch including the flow meter 37 to be closed while the check valve 43 disposed in by-pass 41 of the latter branch as well as the feedback valve 53 are open. The feed pump 45 in feeding duct 25 as well as the circulating pump 6 in circulating duct 5 are operative. Therefore, developer solution 3 is circulated in circulating duct 5, said solution exiting from exit 12 of the tank and entering the tank at inlet 9. As a result of the operation of feed pump 45 whose intake side is connected to junction 27 via the open check valve 43 of the by-pass 41, the storage path 29, the open feedback valve 53 and the feedback duct 49, developer solution 3 is sucked into feedback duct 49 at the junction 27 in proportion with the delivery rate of feed pump 45. The developer solution 3 fills the storage path 29 via feedback duct 49 and feedback valve 53 and flows back to junction 27 via open check valve 43 in by-pass 41, feed pump 45 and filter 47, thus completing its circulation. In other words, in the aforementioned rest condition developer solution 3 circulates through feedback duct 49 and feeding duct 25.

If a fluid additive is to be supplied from one of the supply vessels 13 to 16, check valve 43 in by-pass 41 is closed and check valve 39 opened in the branch of the feeding duct 25 including the flow meter 37. The developer solution 3 now flows through filter 35, flow meter 37 and the open check valve 39. As a result this section of the duct is also flushed by system fluid, i.e., freshly replenished developer solution 3, and the control circuit is moreover able to determine whether the turbine wheel of flow meter 37 rotates. If it does not rotate the flow meter 37 is either blocked or the feed pump 45 or a valve does not work properly (feedback valve 53 or check valve 39 is not open). In this phase of operation therefore, it is possible for the control circuit to carry out an intelligent error detection.

If no error is detected, the feedback valve 53 is closed and subsequently that valve of the feeding valves 19 to 22 opened which is associated with the desired supply vessel. If, for example, concentrate A is to be supplied from supply vessel 14, feeding valve 20 is opened accordingly.

The turbine wheel of flow meter 37 immediately starts rotating and transmits signal pulses to the control circuit. Since feedback valve 53 is closed the flow volume measured by flow meter 37 exactly corresponds to the volume of concentrate A supplied via feed valve 20. After flow meter 37 has fed the desired number of signal pulses to the control circuit and the desired volume of concentrate A has thus been supplied, the control circuit blocks feed valve 20.

The amount of fluid measured by the flow meter depends not only on the number of signal pulses generated by the flow meter in response to the indexing steps of the turbine wheel, but also on the flow rate (milliliters per second) which can be computed from the frequency of the signal pulses. The flow rate in turn depends on several parameters such as hydrostatic pressure, viscosity of the fluid and the like. Such parameters change during operation of the device, for example, if the permeability of filters located in the system changes. Major variations in the physical properties of fluid additives, in particular, the great difference in viscosity between water W and the concentrates A, B and C, also lead to different flow rates when such fluids are fed in.

Considering the aforementioned conditions not only the number of signal pulses (indexing steps) of flow meter 37 but also the frequency of the signal pulses (=number of indexing steps of the turbine wheel per unit time) is determined when one of the concentrates A, B or C or water W is fed in. With reference to a calibrating curve which is established for the flow meter before the device is put in operation and which indicates the flow volume of the system fluid passing through it with reference to the number of signal pulses and the frequency of such pulses, the volume is accurately determined.

During the entire feeding operation it is exclusively developer solution 3 which flows through flow meter 37 because the throughput or storage volume of the storage path 29 between exit point 33 and storage plate 31 and the first upstream end 23 of the feeding duct 25 is dimensioned such that it is larger than the maximum amount of fluid additive to be supplied during one supply step. In this manner it is possible for one flow meter 37 calibrated for measuring the flow volume of the developer solution 3, to carry out its measuring function irrespectively of which of the concentrates A, B or C or water W is supplied. Although the fluid additives usable for replenishing differ greatly with respect to their physical properties, and in particular, their viscosity, one single flow meter need thus be calibrated for one single fluid, namely the developer solution 3, with only the influence of different flow rates having possibly to be taken into account, as was explained above.

Figure 4:
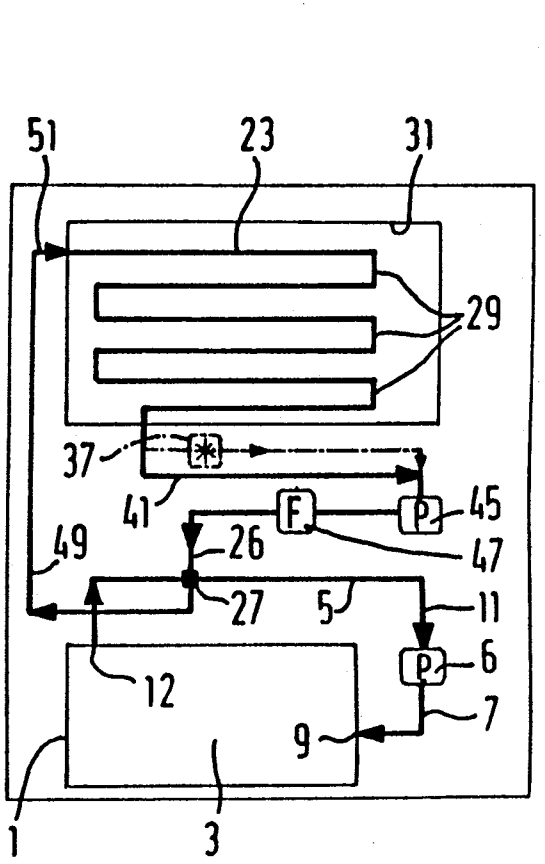
FIGS. 2 to 4 show views similar to that illustrated in FIG. 1. However, on a smaller scale and representing different operative states of the device, with the ducts that are blocked in the respective state appearing in dash-dotted lines.
Figure 3:
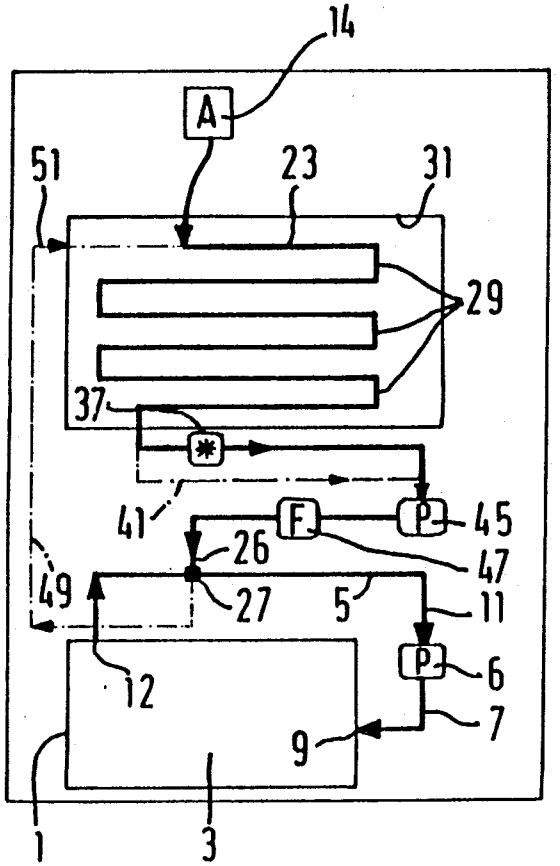
Figure 2:
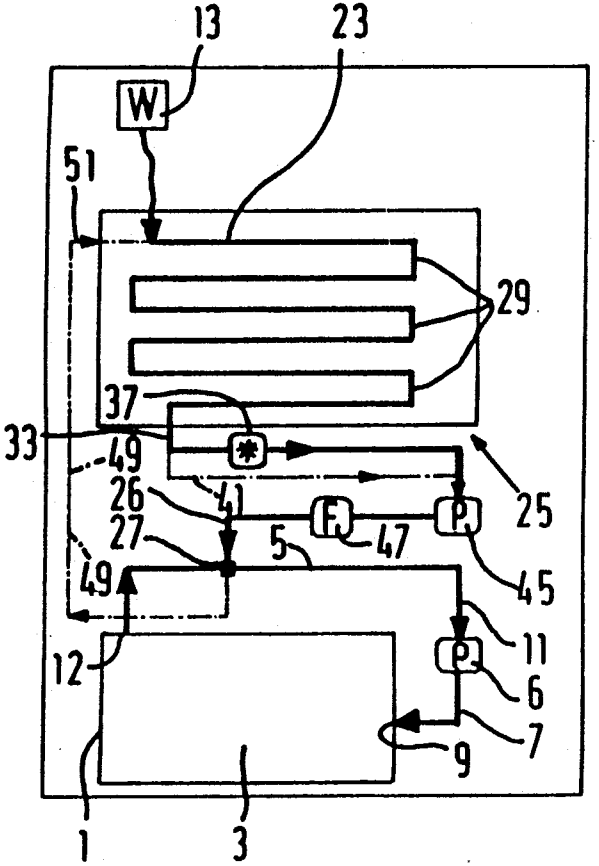

FIG. 4 schematically illustrates the device in its rest condition before the replenishing operation is initiated. The parts of the system through which fluid flows in this condition are shown in full line with the exception of by-pass 55 which is not included in that view. Parts through which no fluid flows in this operative state (the branch in FIG. 4 which includes flow meter 37) are shown in dash-dotted lines. This type of illustration has also been chosen in FIGS. 2 and 3 which will be discussed in the following. FIGS. 2 to 4 only serve to clearly show the flow of the fluid. Therefore, the valves have been omitted in these Figures. FIG. 3 shows the operative condition after a replenishing operation has been started, or more precisely, the supply of concentrate A from supply vessel 14, with concentrate A entering the storage path 29 at the upstream end thereof while the flow meter 37 arranged downstream of storage path 29 is not passed by concentrate A but by developer solution 3 previously stored. As shown in dash-dotted lines, by-pass 41 as well as the feedback duct 49 are blocked in this operative condition.

FIG. 2 shows approximately the same operative state as FIG. 3. However, it is not concentrate A from supply vessel 14, but water W from supply vessel 13 that is supplied. In this case too, it is developer solution 3 stored in the storage path 29 rather than water that flows through the flow meter 37 during the measuring operation.

After a desired fluid additive has been supplied the control circuit (responding to the signal pulses counted by flow meter 37) once again closes the respective feeding valve 19, 20, 21 or 22. Moreover, the check valve 39 located in the branch of flow meter 37 is closed and the check valve 43 of by-pass 41 as well as the feedback valve 53 are opened again. Via feedback duct 49, the fluid circulation is started immediately, with developer solution 3 entering the feedback duct 49 at junction 27, and at end 51 thereof flowing via feedback valve 53 to the first end 23 of the feeding duct 25 which is flushed by the developer solution 3. Flushing and refilling of the storage path 29 with freshly supplied developer solution 3 occurs very rapidly because the fluid rather than circulating through filter 35 and flow meter 37, flows through by-pass 41 and check valve 43 which have a large cross-section. Therefore, the device is very rapidly ready for another replenishing operation.

The feedback of system fluid, i.e., in this embodiment of developer solution 3, through feedback duct 49 to the upstream end 23 of feeding duct 25 is not only advantageous in that, no matter what fluid additive is supplied, the volume can always be measured by one single flow meter 37 but also in that the fluid additives in spite of their being fed in at the same end 23 of one single feed duct 25, are only brought into contact with the system fluid. In other words, since the inlet area is always filled with system fluid through the feedback circulation system, it is impossible for different fluid additives or concentrates to directly contact each other when fed together or successively into the circulation system. This excludes a danger which arises in particular in the case of photographic fluid additives, namely that undesired reactions and/or precipitations occur as a result of the direct contact of chemical substances.

Instead of using feed pump 45 to create the intake force for the feedback circulation in feedback duct 49, developer solution 3 could also branched off from the delivery side of circulating pump 6. In such a case the feedback duct 49 would not be connected to junction 27 but could be directly connected via an additional valve to the delivery side 7 of circulating pump 6. Under such circumstances feed pump 45 could be omitted subject to the system being designed such that fluid additives could be supplied from the supply vessels 13 to 16 under the action of gravity.

The connecting duct 55 forms a throttled branch by which the flow rate, which is produced by feed pump 45 during the feeding of a fluid additive while feedback valve 53 is closed, is limited to a desired extent. Connecting duct 55 moreover attenuates pressure impulses caused by the operation of the valves.

The above description and the drawing are confined to features which are essential for describing an embodiment of the invention. Inasmuch as the features are disclosed in the description and in the drawing but not mentioned in the claims they also serve if necessary for defining the subject matter of the invention.

What is claimed is:

1. A process for the feeding of fluid additives to a photographic processing system fluid contained in a photographic fluid processing system, wherein the fluid additive is supplied at a first end of a feeding duct connected with the fluid processing system and discharged to said system fluid from a second end of said feeding duct, comprising the steps of:

a) supplying different fluid additives successively into the feeding duct, and b) prior to the feeding of a fluid additive which differs from the preceding fluid additive, at least the first end of the feeding duct is filled with system fluid.

2. The process according to claim 1 further comprising the step of determining the volume of each of the fluid additives supplied by measuring the flow volume of the system fluid which is produced in an area of the feeding duct which is filled with system fluid by the feeding in each one of the fluid additives into the feeding duct.

3. The process according to claim 1 further comprising the step of filling the feeding duct with system fluid using a fluid circulation system in which system fluid is fed by a feed pump from the fluid processing system via a feedback duct to the first end of the feeding duct, and prior to the introduction of each fluid additive into said feeding duct the fluid circulation is interrupted by blocking of the feedback duct, said feedback duct is opened again only after the introduction of such additive has been completed and the feeding duct is once again filled with system fluid.

4. The process according to claim 2 further comprising that when the feeding duct is filled, a volume of the system fluid is stored in a storage path which is greater than the volume of the fluid additive to be fed in at the first end of the feeding duct and when the fluid additive is fed in to said feeding duct the flow volume of the system fluid flowing out of said storage path is measured by means of a flow meter.

5. The process according to claim 2 further comprising the step of measuring the flow volume of the system fluid with a flow meter having a turbine wheel, said flow meter during each indexing step of its turbine wheel transmits a signal to a control circuit so as to produce a number and frequency of signals, said control circuit determining the flow rate of said system fluid in response to both the number of signals and the frequency of the signals produced by said flow meter.

6. The process according to claim 5 further comprising the step of taking into account the different flow rates that may occur in the system fluid when measuring the flow volume.

7. A device for feeding fluid additives to a photographic processing system fluid contained in a photographic fluid processing system, said device comprising a feeding duct having a first end connected with supply vessels containing the fluid additives to be supplied and a second end connected with the system fluid to be replenished, at least one feed pump is provided for circulating the system fluid, a valve arrangement is provided which can be actuated by a control circuit for selectively clearing and blocking the feeding duct, said device further comprising:

a) said supply vessels contain different fluid additives, b) the valve arrangement comprises a feed valve for controlling the flow of additives from each supply vessel, c) a feedback duct connected in parallel with the feeding duct is provided through which system fluid can be withdrawn from the fluid processing system by means of at least one feed pump and returned to the first end of feeding duct, and d) the valve arrangement further includes a controllable feedback valve which is arranged in the feedback duct and serves for selectively clearing and blocking the feedback duct.

8. A device according to claim 7 wherein in the feeding duct further includes a storage path whose flow volume is larger than the volume of the fluid additive to be supplied to the feeding duct at any one time and a flow meter is disposed within the feeding duct downstream of the storage path, said flow meter generating a signal which is representative of the size of the flow volume within the feeding duct, said signal being designed for further processing by a signal processing circuit.

9. A device according to claim 8 wherein the feeding duct comprises a by-pass which is connected in parallel with and adapted to by-pass the flow meter, the valve arrangement further includes a controllable check valve connected in series with the flow meter and a second controllable check valve disposed within the by-pass, said first and second controlled check valves serving to block and clear selectively either the by-pass or that part of the feeding duct which includes the flow meter.

10. A device according to claim 9 wherein the part of the feeding duct including the flow meter and the by-pass of flow meter are connected with the downstream end of the storage path of the feeding duct.

11. A device according to claim 7 wherein the fluid processing system comprises a photographic processing tank for holding said photographic processing system fluid having an inlet, an outlet, a circulating duct, a circulating pump having an intake side connected with the outlet and connected with the inlet of tank, the feeding duct terminates in that part of the circulating duct which is connected with the intake side of circulating pump.

12. A device according to claim 11 wherein the end of the feedback duct associated with the fluid system is connected with the circulating duct and the connecting point is located in the area of junction where the feeding duct terminates in the circulating duct.

13. A device according to claim 8 wherein the feedback valve is arranged between the upstream end of the storage path of feeding duct and that end of feedback duct which is associated with the storage path.

14. A device according to claim 8 wherein at least one filter is arranged within the feeding duct downstream of the storage path.

15. A device according to claim 8 wherein a connecting duct between the feedback duct and an area of the feeding duct is disposed downstream of the flow meter and the by-pass.

16. A device according to claim 8 wherein the storage path is formed by a meandrous groove cut into a storage plate and tightly closed at the open side by a cover plate, and the feed valve of each of said supply vessels and the feedback valve are arranged on said storage plate and/or said cover plate.

* * * * *